US006176308B1

(12) United States Patent
Pearson

(10) Patent No.: US 6,176,308 B1
(45) Date of Patent: Jan. 23, 2001

(54) INDUCTOR SYSTEM FOR A SUBMERSIBLE PUMPING SYSTEM

(75) Inventor: Donald R. Pearson, Bartlesville, OK (US)

(73) Assignee: Camco International, Inc., Houston, TX (US)

( * ) Notice: Under 35 U.S.C. 154(b), the term of this patent shall be extended for 0 days.

(21) Appl. No.: 09/093,300

(22) Filed: Jun. 8, 1998

(51) Int. Cl.[7] ..... H01F 27/02; H01F 27/06
(52) U.S. Cl. ..... 166/65.1; 336/67; 336/92
(58) Field of Search ..... 336/92, 90, 67, 336/65; 166/65.1, 66.5

(56) References Cited

U.S. PATENT DOCUMENTS

| | | | | |
|---|---|---|---|---|
| 1,586,082 | * | 5/1926 | Gilbert | 336/179 |
| 2,079,697 | * | 5/1937 | Ranges | 336/92 |
| 2,168,351 | * | 8/1939 | Rue et al. | 336/131 |
| 2,548,205 | * | 4/1951 | Drobish et al. | 336/92 |
| 2,732,529 | * | 1/1956 | Reid et al. | 333/179 |
| 2,976,502 | * | 3/1961 | Hill | 336/83 |
| 3,020,502 | * | 2/1962 | Graham | 336/73 |
| 3,883,797 | * | 5/1975 | Abrukin | 166/66 |
| 4,400,858 | | 8/1983 | Goiffon et al. | 24/255 |
| 4,687,054 | * | 8/1987 | Russell et al. | 166/66.4 |
| 4,754,250 | | 6/1988 | Duin | 336/65 |
| 5,282,508 | * | 2/1994 | Ellingsen et al. | 166/249 |
| 5,323,855 | * | 6/1994 | Evans | 166/248 |
| 5,515,038 | | 5/1996 | Smith | 340/853.3 |

FOREIGN PATENT DOCUMENTS

| | | |
|---|---|---|
| 0 008 048 | 2/1980 | (EP) . |
| 0 314 107 | 5/1989 | (EP) . |
| 2 115 554 | 9/1983 | (GB) . |
| 2 206 968 | 1/1989 | (GB) . |
| 2 257 307 | 1/1993 | (GB) . |
| 2 283 889 | 5/1995 | (GB) . |
| WO96/24235 | 8/1996 | (WO) . |

* cited by examiner

*Primary Examiner*—Hoang Dang
(74) *Attorney, Agent, or Firm*—Fletcher, Yoder & Van Someren

(57) ABSTRACT

An inductor assembly is disclosed for protecting electronic circuitry in a downhole equipment string. The inductor assembly includes a plurality of modular inductors coupled to one another in series to provide the desired inductance. The modular inductors are supported by a support structure in a protective housing, such as in a common housing with the electronic circuitry. The inductor assembly is electrically isolated from the housing. The support structure may include insulative end members and rail members extending between the end members to which the inductors are secured. One or more insulative covers are provided around the inductors to further isolate the inductors from the housing. The inductor assembly dissipates energy in the event of certain failure modes of power supply circuitry or lines extending from the earth's surface. The inductor may be secured electrically between a neutral node in a Y-wound motor to prevent high voltage ac waveforms from damaging the electronic circuitry. Insulation of the inductors inhibits arcing with the housing, thereby inhibiting damage to the inductors or the electronic circuitry during such failure modes.

15 Claims, 5 Drawing Sheets

INDUCTOR SYSTEM FOR A SUBMERSIBLE PUMPING SYSTEM

BACKGROUND OF THE INVENTION

1. Field of the Invention

The present invention relates generally to the field of submersible pumping systems of the type used in petroleum production and similar well applications. More particularly, the invention relates to a technique for protecting circuitry associated with such pumping systems, such as electronic circuitry for measuring or processing sensed or controlled parameters through the use of an inductor assembly.

2. Description of the Related Art

A variety of equipment is known and is presently in use for handling fluids in wells, such as petroleum or gas production wells. For example, a known class of such equipment includes submersible pumping systems, which typically comprise a submersible electric motor and at least one pump coupled to the electric motor. The pumping system may also include such equipment as motor protectors, fluid separators, and measuring or control equipment, such as digital or analog circuitry.

The equipment may be deployed in a wellbore in a variety of manners. For example, a submersible pumping system may be lowered into a desired position within a wellbore via a cable coupled to a wire line or similar deployment device at the earth's surface. Power and data transmission lines are typically bound to the suspension cable for conveying power to the submersed equipment, as well as for conveying control signals to controllable components, such as valving, instrumentation, and so forth, and for transmitting parameter signals from the equipment to the earth's surface. In an alternative technique, the equipment may be coupled to a length of conduit, such as coiled tubing, and similarly lowered into a desired position within the well. In coiled tubing-deployed systems, power and data transmission cables may be positioned outside the coiled tubing, or may be disposed within the elongated bore defined by the coiled tubing.

Once positioned in the well, circuits in the equipment are energized to perform desired functions. For example, in the case of submersible pumping systems, electrical power, typically in the form of three-phase alternating current power, is applied to the electric motor to drive the equipment in rotation. A pump thereby displaces wellbore fluids either through a stand of conduit to the earth's surface, or directly through a region of the well casing surrounding the cable or coiled tubing by which the equipment is deployed. Other well equipment may perform additional functions, such as reinjecting non-production fluids into subterranean discharge zones. In addition, powered well equipment may perform measurement functions, drilling functions, and so forth.

In an increasing number of applications, rather sensitive electronic equipment is deployed in wells along with powered equipment. Electronic circuitry associated with the equipment will typically perform measurement or controlling functions, or both. In such cases, it is often necessary to provide a desired level of electrical power to the electronic circuitry. This is advantageously done by means of a common cable assembly used to supply power to the driven equipment. In the case of submersible electric motors, one technique for supplying power to measuring and control circuitry includes superimposing a desired power signal on the alternating current power used to drive the electric motor. At a Y-point of the motor windings, the power can be tapped and fed to the electronic circuitry.

While it is advantageous to provide electrical power for monitoring and control circuitry by a power signal superimposed on drive power, this technique may call for protective circuitry in the event of certain failure modes. For example, where dc power is tapped from the Y-point of motor windings, a ground fault or loss of a phase in the motor drive circuitry can lead to referencing of the Y-point (i.e., a higher than desired power level at the Y-point). Such faults can cause damage to the downstream dc circuitry necessitating removal and servicing, and resulting in down time and maintenance costs. To protect the circuitry, inductors or chokes may be employed to prevent high voltage and current power from quickly entering the dc circuitry. However, existing choke structures do not typically provide sufficient protection for the circuitry. For example, in inverter motor drives, very high voltage spikes may occur at the Y-point of the motor windings, depending upon the failure mode. Such spikes can seriously damage conventional chokes. Larger or higher capacity choke structures may be provided, but these are typically limited by the dimensions of the wellbore, effectively limiting the options for increasing of the size or inductance of conventional choke structures.

There is a need, therefore, for an improved technique for protecting electronic circuitry supplied with power from powered equipment in well applications. In particular, there is a need for an improved structure which provides both dielectric strength as required by the anticipated level of voltage and current spikes, while providing sufficient inductance to dissipate power during such periods. There is also a need for a structure which can be manufactured and adapted to both new and existing applications, and which can be integrated into existing equipment envelopes, such as those dictated by the dimensions of conventional wells.

SUMMARY OF THE INVENTION

The invention provides a technique for inductively protecting electronic circuitry designed to respond to these needs. The technique may be employed in a variety of well environments, but is particularly well suited for use with equipment in petroleum, gas, and similar wells. The technique provides an electrical inductor structure which can be positioned between powered equipment and electronic circuitry to inhibit power spikes from being transmitted to the electronic circuitry which would otherwise cause damage. The inductor may be configured as a modular structure, such that an overall inductance level can be attained by associating a plurality of modules into a series arrangement. The technique is particularly well suited for use in systems wherein electronic circuitry is powered via a power signal superimposed over drive signals in a three-phase circuit. The inductor may also pass parameter signals back through the power circuitry to a surface location.

Thus, in accordance with the first aspect of the invention, an inductor system is provided for an equipment string configured to be deployed in a well. The equipment string includes at least one powered component coupled to a power cable extending between the earth's surface and the equipment string. The inductor system is configured to be coupled between the powered component and a direct current circuit receiving power via the power cable. The system includes an inductor and an electrically insulative support structure. The inductor includes a conductive coil and a ferromagnetic core. The support structure includes a support portion configured to contact and retain the inductor, and an interface portion coupled to the support portion for supporting the inductor in a conductive housing. The support structure electrically isolates the inductor from the conductive housing. The support structure may include both conductive and insulative materials, such as end members made of an insulative material for mechanically supporting the inductor and for contacting conductive internal surfaces of the housing. The inductor may be formed of a plurality of inductor modules. The inductor is preferably covered by an insulative jacket or wrap to further electrically isolate it from conductive surfaces within the housing.

In accordance with another aspect of the invention, an inductor assembly is provided for protecting an electronic circuit in a downhole tool. The assembly includes a plurality of modular, series-coupled inductors. An insulative support structure is coupled to the inductors and mechanically supports the inductors in a housing. The support structure electrically isolates the inductors from conductive surfaces within the housing. An insulative cover extends over the inductors to isolate the inductors from conductive surfaces within the housing. The support structure may include one or more insulative end members configured to support the inductors and to contact interior surfaces of the housing.

In accordance with a further aspect of the invention, an electronic circuit module is provided for use in a downhole tool string. The module includes a housing configured to be secured to at least one other component in the tool string. An electronic unit is positioned within the housing. An inductor assembly is electrically coupled to the electronic unit and is supported within the housing. The inductor assembly includes an inductor and an insulative support for positioning the inductor assembly in the housing.

In accordance with still another aspect of the invention, a submersible pumping system is provided for use in a well. The system includes a pump, a submersible electric motor drivingly coupled to the pump, and an electronic circuit module. The motor is configured to be coupled to a power cable assembly for providing electrical power from the earth's surface to the electric motor when the pumping system is deployed in the well. The electronic circuit module is powered by electrical energy transmitted through the cable. The electronic circuit module includes a conductive housing, an electronic circuit unit disposed in the housing, and an inductor assembly. The inductor assembly is electrically coupled to the electronic circuit unit in the housing and includes insulating members for electrically isolating the inductor assembly from conductive surfaces within the housing. The electric motor may be a polyphase motor, and the inductor may be electrically coupled to a junction point of phase windings so as to provide electrical power to the electronic circuit module via the phase windings.

A method is also provided for protecting an electronic circuit in a tool string submersible in a well. In accordance with the method an inductor assembly is provided including at least one inductor for dissipating electrical energy. The inductor assembly is mounted in a protective housing configured to be assembled in the tool string. The inductor assembly is electrically insulated to inhibit arcing between the inductor assembly and conductive elements within the housing. The inductor assembly is electrically coupled between the electronic circuit and a source of electrical energy.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
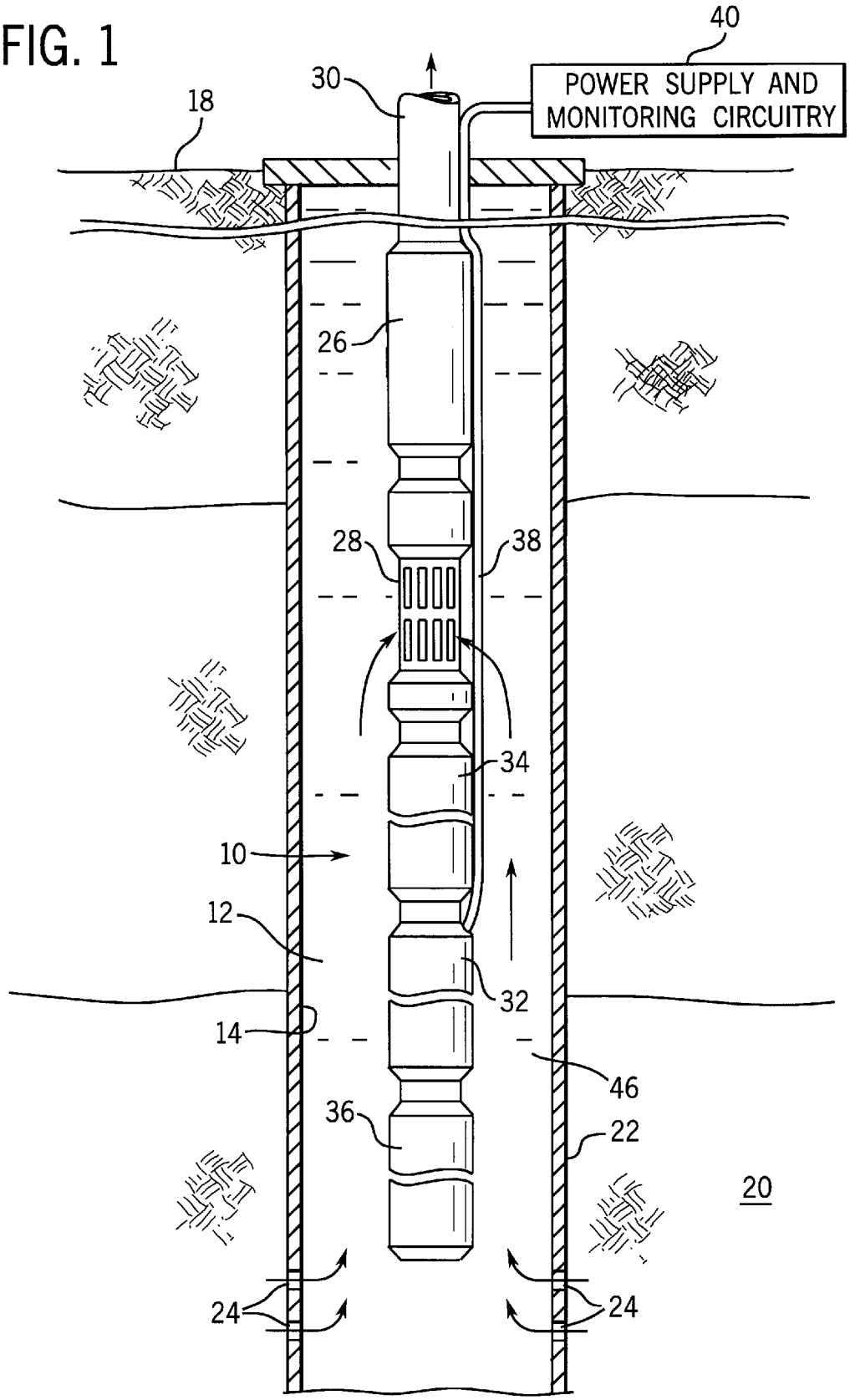
FIG. 1 is an elevational view of an equipment string positioned in a petroleum production well.

Turning now to the Figures, and referring first to FIG. 1, an equipment string 10 is illustrated in the form of a submersible pumping system deployed in a well 12. Well 12 is defined by a wellbore 14 which traverses a number of subterranean zones or horizons. Fluids 16 are permitted to flow into and collect within wellbore 14 and are transmitted, via equipment string 10, to a location above the earth's surface 18 for collection and processing. In the embodiment illustrated in FIG. 1, the pumping system is positioned adjacent to a production horizon 20 which is a geological formation containing fluids, such as oil, condensate, gas, water and so forth. Wellbore 14 is surrounded by a well casing 22 in which perforations 24 are formed to permit fluids 16 to flow into the wellbore from production horizon 20. It should be noted that, while a generally vertical well is illustrated in FIG. 1, the equipment string 10 may be deployed in inclined and horizontal wellbores as well, and in wells having one or more production zones, one or more discharge zones, and so forth, in various physical layouts and configurations.

In the embodiment illustrated in FIG. 1, equipment string 10 includes a production pump 26 configured to draw wellbore fluids into an inlet module 28 and to express the wellbore fluids through a production conduit 30 to the earth's surface. Pump 26 is driven by a submersible electric motor 32. A motor protector 34 is preferably provided to prevent wellbore fluids from penetrating into motor 32 when deployed in the well. An electronic module, represented generally at reference numeral 36, is coupled to motor 32 and may include a variety of electronic circuitry for executing monitoring and control functions. In particular, electronic module 36 may include circuitry for monitoring operating parameters within well 12, such as temperatures, pressures, and so forth. In addition, the module may include circuitry for carrying out in situ control functions, such as for controlling operation of motor 34. Moreover, as discussed in greater detail below, module 36 preferably includes circuitry for encoding or encrypting digital data for retransmission to the earth's surface. Finally, module 36 includes an inductor assembly as described in greater detail below for protecting electronic circuitry from damage due to certain failure modes or anomalies in the electrical supply circuitry associated with equipment string 10.

In the illustrated embodiment motor 32 receives electrical power from a surface location via a multi-conductor cable 38. Cable 38 is routed beside equipment string 10 and production conduit 30 and terminates at power supply and monitoring circuitry above the earth's surface, as represented by generally by the reference numeral 40. In operation, power supply and monitoring circuitry 40 transmits electrical power, preferably three-phase alternating current power, to motor 32 via cable 38. Circuitry 40 also preferably applies a direct current voltage, such as a 78 volt dc regulated power signal, over the alternating current power applied via cable 38. The direct current voltage passes through motor 32 and is transmitted therefrom to electronic module 36. Parameter signals for monitoring or controlling equipment within string 10 are transmitted back to circuitry 40 along cable 38.

As will be appreciated by those skilled in the art, electronic module 36 may be incorporated in a variety of equipment strings, such as that illustrated in FIG. 1, as well as alternative equipment strings. Such equipment strings may include additional or other components, such as injection pumps, fluid separators, fluid/gas separators, packers, and so forth. Moreover, while in the embodiment described below power is applied to electronic module 36 via cable 38, various alternative configurations may be envisaged wherein power applied to electronic module 36 does not pass through windings of motor 32 as described below. Similarly, electronic module 36 may be configured to transmit parameter signals to the earth's surface via alternative techniques other than through cable 38, such as via radio telemetry, a separate communications conductor, and so forth.

Figure 2:
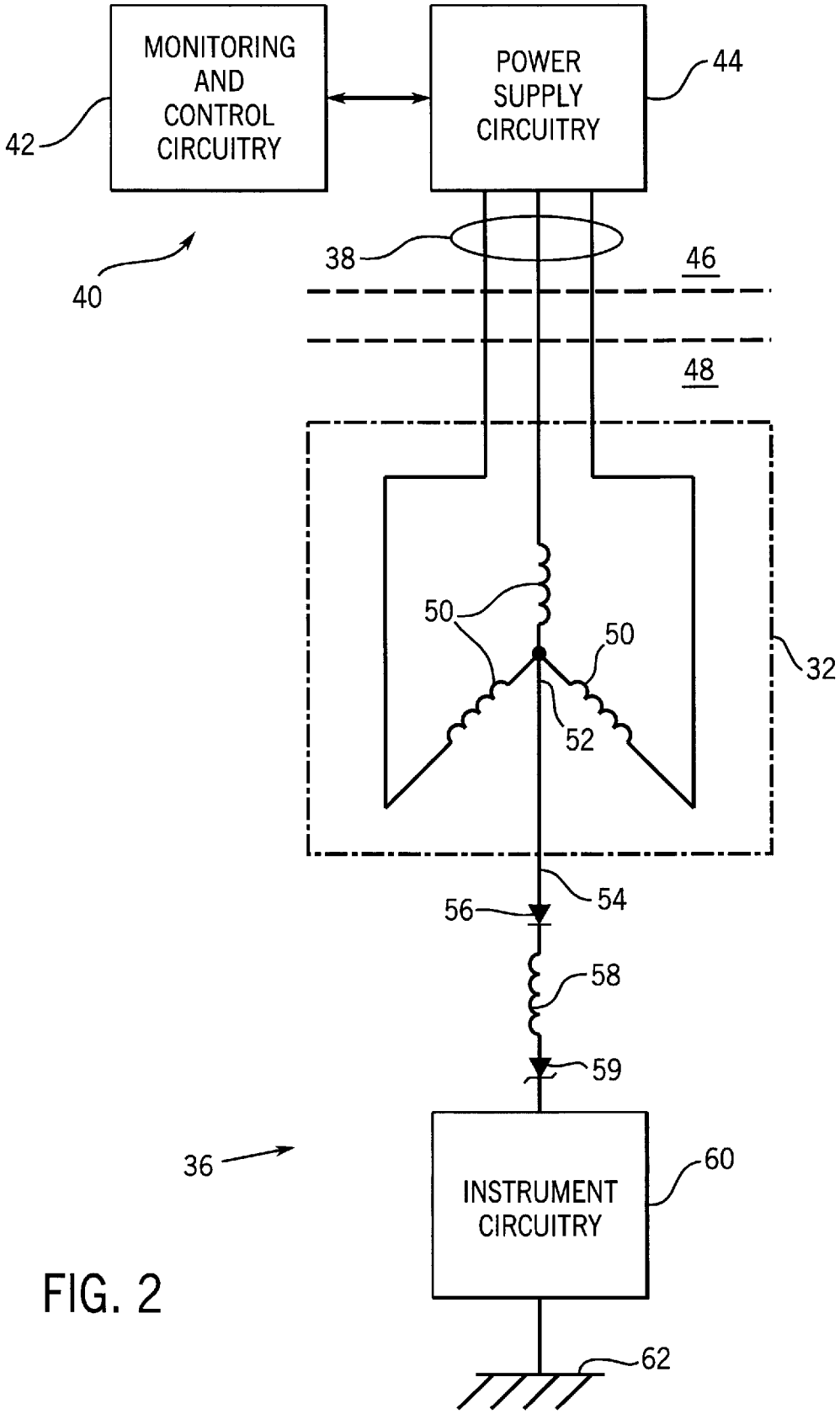
FIG. 2 is an electrical schematic diagram of a power supply circuit for applying electrical power to a submersible electric motor in the system of FIG. 1, as well as to instrumentation, monitoring, control or similar equipment positioned in the well.

A presently preferred configuration for supplying power to circuitry within module 36 through motor 32 is illustrated in FIG. 2. In general, the technique employed for applying power and transmitting signals to and from the electronic module may conform to the technique described in U.S. Pat. No. 5,515,038, issued to Alistair Smith on May 7, 1996 and assigned to Camco International Inc. of Houston, Tex., which is hereby incorporated into the present disclosure by reference. As illustrated in FIG. 2, circuitry 40 generally comprises monitoring and control circuitry 42 configured to generate signals for prompting transmission of information from the tool string when deployed. Circuitry 42 may also generate control signals for commanding operation of components of the equipment string, such as the speed of the electric motor, position of control valves (not shown), and so forth. Monitoring and control circuitry 42 is coupled to power supply circuitry 44 which generates power needed for operation of the equipment string. Power supply circuitry 44 may be of a generally known configuration, and will typically include switch gear for connecting the equipment to a source of three-phase electrical power, as well as circuit protective devices, overload protective devices, and so forth. In the presently preferred embodiment, power supply circuitry 44 also provides a fixed direct current voltage of 78 volts dc, which is superimposed over alternating current power applied to the equipment via cable 38.

In the diagrammatical representation of FIG. 2, cable 38, including three phase conductors, extends from the location of circuitry 44 above the earth's surface, as represented by reference numeral 46 in FIG. 2, to the location of the electric motor 32 below the earth's surface, as represented by reference numeral 48 in FIG. 2. Motor 32 is then coupled, such as via a sealed electrical coupling (not shown) to the conductors of cable 38. Stator windings 50 are coupled in a Y-configuration as illustrated in FIG. 2 to drive a rotor of the motor in rotation, thereby driving pump 26 (see FIG. 1). Stator windings 50 join one another at a Y-point 52, which defines a neutral node of the motor windings. This node point will, during normal operation, have a neutral relative potential. However, when a direct current power signal is superimposed over the conductors of cable 38, this direct current potential difference will result at node point 52 during normal operation. Power from node point 52 is transmitted to circuitry within electronic module 36 via a jumper conductor 54.

Within module 36, power incoming from motor 32 is routed through protective filtering circuitry, including a diode 56, an inductor 58 and a Zener diode 59. Power is thus transmitted to instrument circuitry 60 to provide power for operation of the circuitry. Circuitry 60 may include dc power supplies, voltage regulators, current regulators, microprocessor circuitry, solid state memory devices, and so forth. Instrument circuitry 60 is coupled to a ground potential as represented generally at reference numeral 62 in FIG. 2. This ground potential will normally be provided by the housing of module 36 as described more fully below.

As mentioned above, during normal operation of the circuitry as configured in FIG. 2, neutral node 52 will remain at the direct current voltage desired to be applied to instrument circuitry 60 through diode 56, inductor 58 and Zener diode 59. However, in the event of a ground fault, loss of phase or similar fault condition within motor 32 or within the circuitry applying power to motor 32, neutral point 52 may experience spikes in potential, including sizable alternating current spikes of a voltage level capable of damaging or crippling instrument circuitry 60. Upon the occurrence of such spikes, diode 56 serves to clip alternating or pulsed waveforms, such as to limit such waveforms applied to inductor 58 to unidirectional voltage pulses. Inductor 58, which may be a 10,000 volt diode, then dissipates energy from the pulses due to its high inductance level so as to prevent damage to circuitry 60. Zener diode 59, which may be a 68 volt diode, regulates dissipation of the energy. In a presently preferred embodiment, inductor 58 is a 200 Henry inductor, comprised of a series of modular inductors coupled to one another in series.

Figure 3:
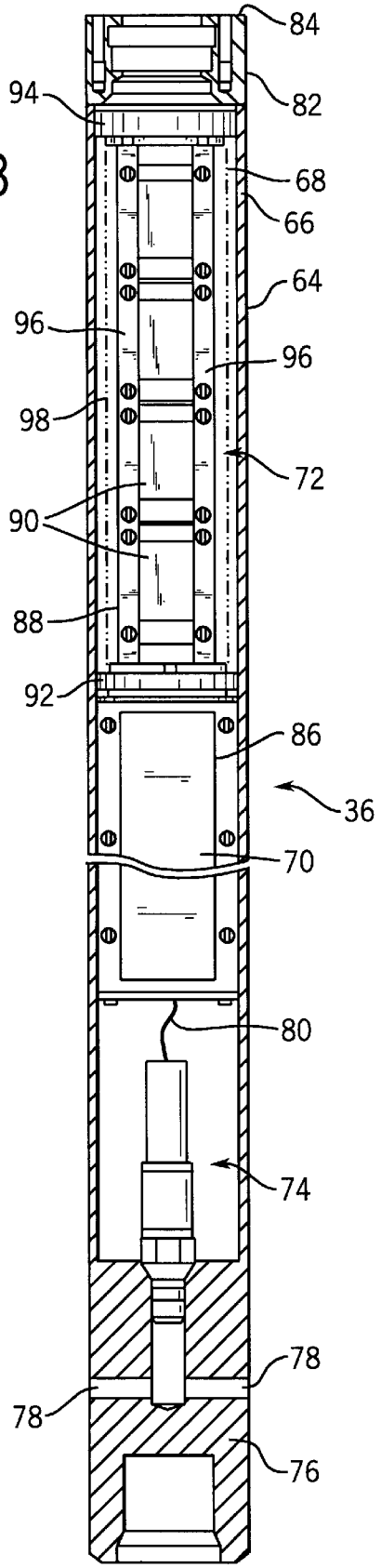
FIG. 3 is an elevational view of a parameter measurement device including a series of modular inductors for protecting electronic circuitry within the device.

FIG. 3 illustrates an exemplary physical configuration for electronic module 36, including electronic circuitry, parameter measurement circuitry, and an inductor assembly for protecting the circuitry from power spikes during certain types of failure modes. While the electronic circuitry and the inductor assembly may be provided in separate component modules, in a presently preferred configuration illustrated in FIG. 3, these are housed in a common elongated housing 64 formed of a metal shell 66 surrounding an internal cavity 68 in which the components are disposed. As will be appreciated by those skilled in the art, the housing is sized to permit its insertion into a petroleum production well or a similar well, in conjunction with associated equipment. Within internal cavity 68, module 36 thus includes an electronic unit 70, and an inductor assembly 72. Moreover, because the illustrated embodiment is a measurement or sensing device, a sensor assembly 74 is also provided within housing 64. At a lower end of housing 64, shell 66 is terminated by a lower end cap 76 in which sensor assembly 74 is installed. In the illustrated embodiment sensor assembly 74 includes circuitry for measuring temperatures and pressures within a wellbore. Accordingly, end cap 76 includes a plurality of openings or apertures 78 for permitting wellbore fluids penetrate into end cap 76 for measurement by assembly 74. Sensor assembly 74 is coupled to electronic unit 70 via a jumper or conductor set 80.

An upper end of housing 64 is provided with an upper end cap 82 permitting the module to be coupled to additional components within an equipment string, such as to an electric motor 32 as illustrated in FIG. 1. Thus, upper end cap 82 includes a flanged interface 84 for receiving fasteners (not shown) for securing the components of the equipment string to one another. As will be appreciated by those skilled in the art, upper end cap 82 may either be open to the interior cavity of an adjacent component or may be sealed. For example, where desired, the interior of module 36 may be in fluid communication with the interior of an electric motor coupled adjacent to it in the equipment string, and may share a common internal fluid with the motor, such as a high grade mineral oil. Alternatively, end cap 82 may provide a sealed interface between the motor and the components within housing 64. In such cases, a sealed electrical connection may be provided in end cap 82 in a manner generally known in the art, to permit the exchange of electrical power and signals between circuitry within module 36 and electrical conductors within a motor or other component. Also, electronic circuitry housed within module 36 may be conveniently provided in an electronic circuit enclosure 86. In a presently preferred embodiment, electronic circuitry housed within enclosure 86, and sensor circuitry in assembly 74 may be of the type commercially available in a measurement module from Reda of Bartlesville, Okla. under the commercial designation Downhole Measurement Tool.

In the embodiment of FIG. 3, inductor assembly 72 includes a support structure, represented generally by reference numeral 88, and series of modular inductors 90. Support structure 88 mechanically supports the inductors within housing 64, while electrically isolating the inductors from conductive surfaces within housing 64. In prior art systems, it has been found that grounding between inductors within a conductive housing can lead to failure of the inductors through short circuits produced either between the inductors and the housing or within the inductor units themselves. The support structure provided for inductors 90 inhibits such contacts by providing a non-conductive barrier between the inductors and the housing. In particular, support structure 88 includes a lower insulative end member 92 and an upper insulative end member 94 which position inductors 90 in a desired location within housing 64, while providing a non-conductive interface between the inductors and the housing. The support structure further includes mechanical supports, such as in the form of rails 96 extending between lower and upper insulative end members 92 and 94. In the illustrated embodiment, inductors 90 are secured to rails 96 via bolts or similar fasteners 98. Rails 96 may be made of a conductive material, or an insulative material, where desired. An insulative jacket 100, represented generally by a dashed line in FIG. 3, and described more fully below, is preferably provided around inductors 90. Although jacket 100 may be provided within housing 64 separate from the inductor assembly, it is preferably secured directly to the inductor assembly to facilitate preconfiguring of the assembly and insertion of the assembly into housing 64.

Figure 4:
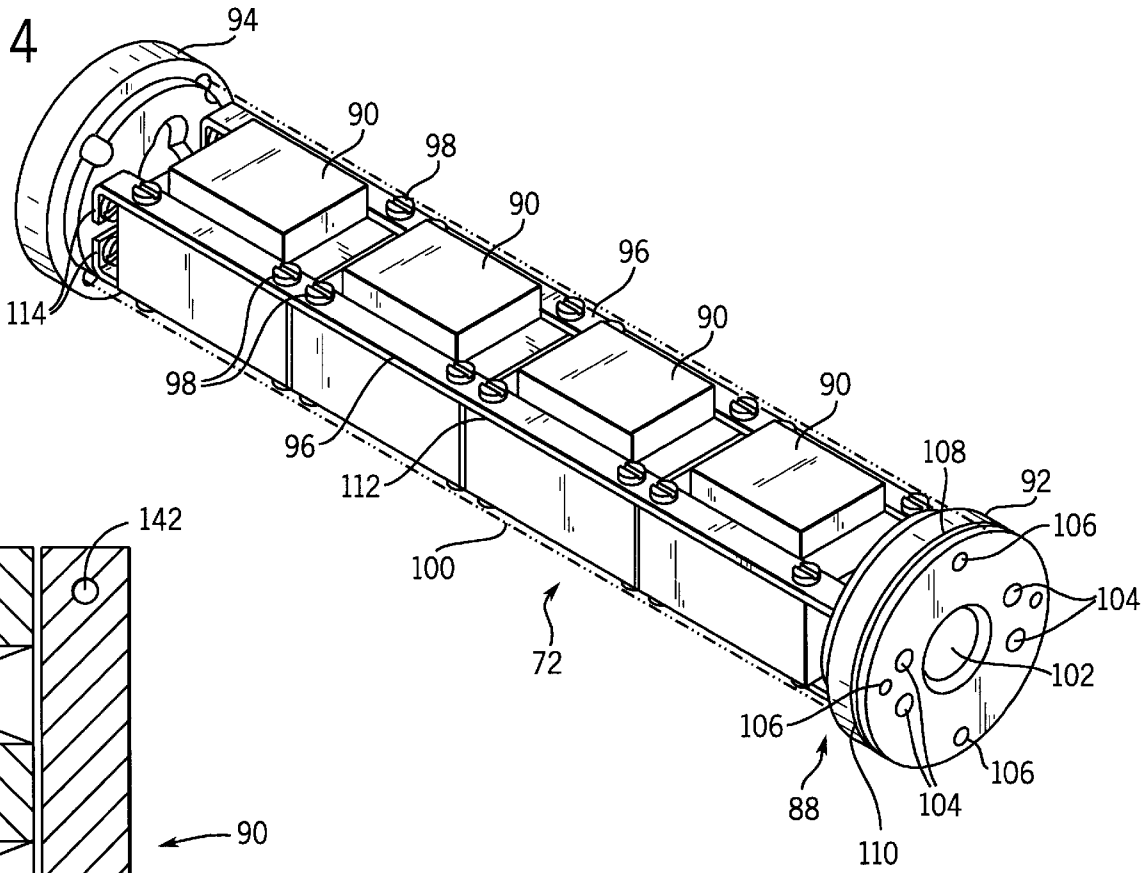
FIG. 4 is a perspective view of an assembly of modular inductors of the type illustrated in FIG. 3.

As best illustrated in FIG. 4, the support structure 88 for inductor assembly 72 both supports the inductors and isolates the inductors electrically from adjacent components. As shown in FIG. 4, end members 92 and 94 serve as interface members between the inductors and other components. Thus, lower insulative end member 92 includes a central wiring aperture 102 through which a conductor can be passed after wiring of the inductors as described below. Moreover, rail mounting apertures 104 are provided in both lower and upper end members 92 and 94 to receive fasteners for securing rails 96 to the end members. Additional mounting apertures, such as apertures 106 in lower insulative end member 92 may be provided, such as for supporting circuit enclosure 86 (see FIG. 3). Moreover, one or both end members may include seals or gaskets for securing the insulator assembly within the housing in a relatively resilient manner. In the illustrated embodiment, for example, lower end member 92 includes an annular gasket groove 108 in which an elastomeric ring or gasket 110 is positioned to maintain radial alignment of the end member within housing 64 (see, e.g., FIGS. 5 and 6). Also as illustrated in FIG. 4, in the present embodiment, rails 96 include bent end portions 114 through which fasteners are positioned for securing the rails to end members 92 and 94.

Figure 5:
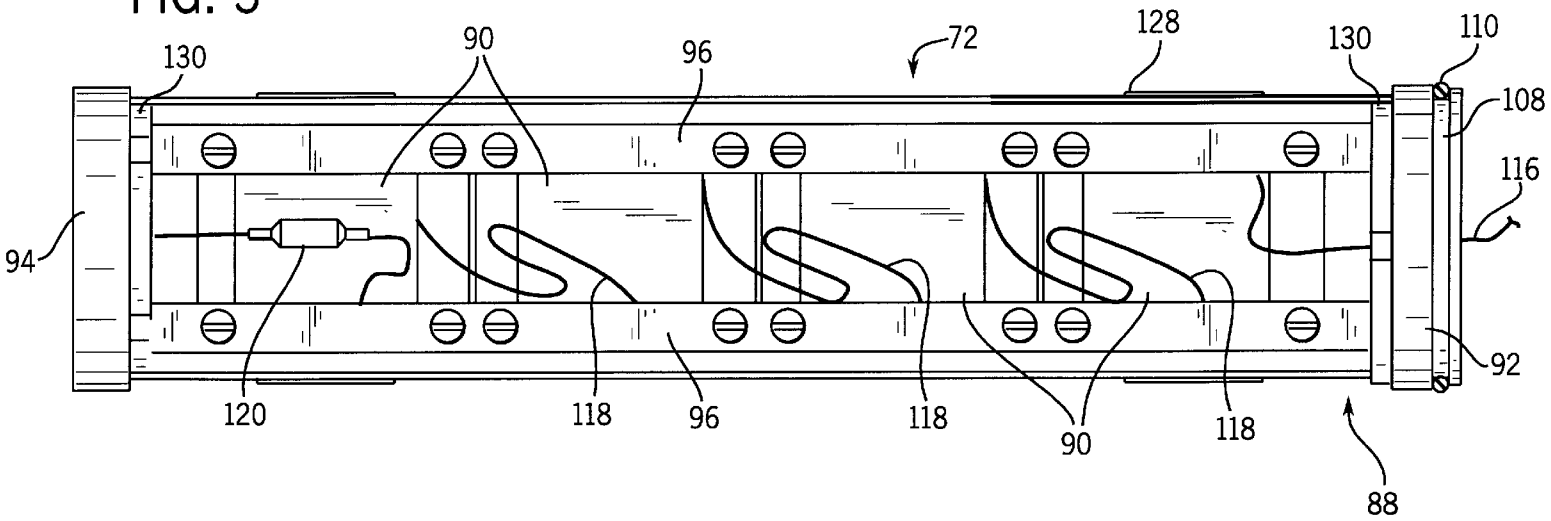
FIG. 5 is a top plan view of the inductor assembly of FIG. 4.
Figure 6:
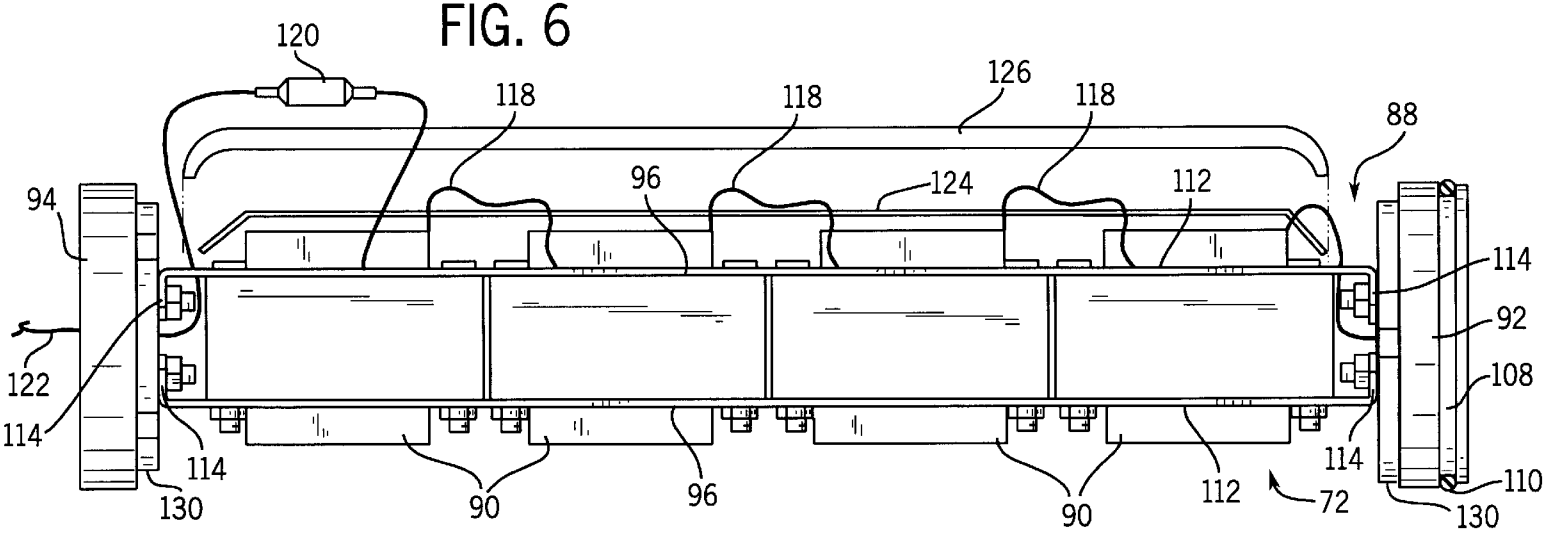
FIG. 6 is a side elevational view of the inductor assembly of FIG. 4.

FIGS. 5 and 6 illustrate the components of the inductor assembly in somewhat greater detail. In particular, as shown in FIGS. 5 and 6, four 50 Henry inductors 90 are coupled to one another in series to form the 200 Henry inductor desired for protection of the electronic circuitry. As will be appreciated by those skilled in the art, other inductor ratings and combinations may be foreseen to provide an overall inductance as needed for protection of particular circuits. A lead 116 extends from lower end member 92 and, in the assembled module, is coupled to a Zener diode and, therethrough, to electronic circuitry as illustrated diagrammatically in FIG. 2. Between each adjacent pair of inductors 90, leads are coupled to one another in series as indicated at reference numeral 118. Splices between the leads may be covered with a heat shrink insulative jacket of a type well known in the art. A diode subassembly 120 is preferably provided on the last inductor 90 adjacent to upper end member 94, and includes a diode for clipping negative-going pulses as discussed above with regard to diode 56 of FIG. 2. From diode assembly 120, an input lead 122 extends through upper end member 94 (see FIG. 6) for coupling to a source of electrical power, such as a neutral node point of the motor windings as illustrated in FIG. 2.

In the presently preferred embodiment illustrated in FIGS. 5 and 6, inductors 90 are further isolated from conductive components by a series of insulative panels or covers 124, 126 and 128. A first insulative panel 124 is provided directly adjacent to sides of the inductors, such as below leads 118. Although a single panel 124 is illustrated in FIG. 6, similar panels may be provided around all sides of the inductor assembly. A further insulative panel 126 is provided above panel 124 to further insulate the leads and inductors from surrounding components. Finally, an insulative wrap 128 (see FIG. 5) is provided around panels 124 and 126. In the preferred embodiment, insulative cover 128 extends between shoulders 130 provided on end members 92 and 94, to define a structure in which substantially all conductive components are insulated from the internal surfaces of housing 64 when installed therein as illustrated in FIG. 3.

Any suitable material may be used for insulating inductors 90 from conductive surfaces within housing 64. In a presently preferred embodiment, for example, end members 92 and 94 are constructed of a high temperature engineering plastic, such as a plastic material available under the commercial designation Ultem 2300. Moreover, in the present embodiment, insulative panels 124 and 126 and insulative cover 128 are constructed of an insulative plastic material commercially available under the name Nomex from DuPont. Additional insulative materials, such as tetrafluoroethylene tubes may be provided around at least a portion of insulative cover 128, where desired.

Figure 7:
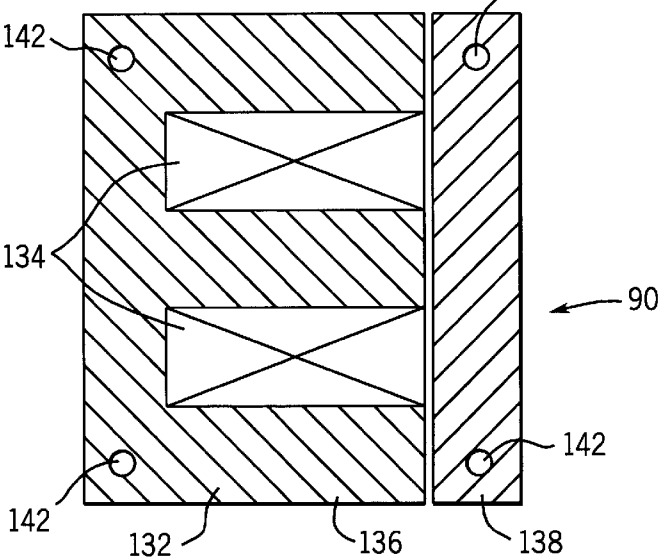
FIG. 7 is a sectional view of one of the modular inductors of the assembly of FIG. 4.

FIG. 7 illustrates a typical configuration for each inductor module 90 shown in vertical section. As shown in FIG. 7, the modules include a core assembly 132 and windings 134 of an electrically conductive material, such as copper. Core 132 is preferably made of a ferromagnetic metal, such as steel, and includes an "E" section 136 designed to receive windings 134, and an "I" section 138 which serves to cover and enclose the windings. Sections 136 and 138 are secured to one another during assembly of the inductor. Moreover, the windings 134 are insulated turn-to-turn, and are further insulated from the core in a conventional manner. Core sections 136 and 138 maybe constructed of plate-like steel laminations in a manner generally known in the art. Apertures 142 are provided through core 132 for receiving fasteners used for securing the inductor modules to the support structure described above (see FIGS. 4, 5 and 6). Leads (not shown in FIG. 7) extend from windings 134 to the outside of the core 132 to permit the windings to be electrically coupled in series between a source of electrical power and a protected circuit as described above.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An inductor system for an equipment string configured to be deployed in a well, the equipment string including at least one powered component coupled to a power cable extending between the earth's surface and the equipment string when deployed, and a direct current circuit receiving power via the power cable, the inductor system being configured to be coupled between the powered component and the direct current circuit, the inductor system comprising:

an inductor including a conductive coil and a ferromagnetic core;

an electrically insulative support structure including an support portion configured to contact and retain the inductor, and an interface portion coupled to the support portion for supporting the inductor in a conductive housing, the support structure electrically isolating the inductor from the conductive housing; and an insulative covering extending over the inductor to isolate the inductor and the support portion from surrounding conductive surfaces within the housing, the support portion including a plurality of support rails secured to the inductor and the insulative covering including at least one insulative jacket disposed around the support rails and the inductor.

2. The inductor system of claim 1, wherein the interface portion of the support structure includes at least one end member comprising an insulative material, the end member being mechanically coupled to the support portion to hold the support portion at a desired location within the housing.

3. The inductor system of claim 2, wherein the interface portion includes a pair disk-like end members comprising an insulative material, the end members being mechanically coupled to the support portion.

4. The inductor system of claim 1, wherein the inductor includes a plurality of inductor modules, each inductor module having a coil and core for dissipating electrical energy.

5. An inductor assembly for protecting an electronic circuit in a downhole tool, the inductor assembly comprising:

a housing coupleable to a downhole tool string;

a plurality of modular, series-coupled inductors;

an insulative support structure coupled to the inductors and mechanically supporting the inductors in the housing and electrically isolating the inductors from conductive surfaces within the housing; and an insulative cover extending over the inductors to isolate the inductors from conductive surfaces within the housing.

6. The inductor assembly of claim 5, wherein the support structure includes at least one insulative end member configured to support the inductors and to contact an interior surface of the housing and thereby to maintain the inductors in a desired position within the housing.

7. The inductor assembly of claim 6, wherein the support structure includes a pair of insulative end members and a central support mechanically coupled to and supported by the end members.

8. The inductor assembly of claim 7, wherein the central support includes at least one elongated member secured to the inductors to support the inductors between the end members.

9. The inductor assembly of claim 8, wherein at least a portion of the elongated member is electrically conductive, and wherein the insulative cover extends over the conductive portion of the elongated member to isolate the elongated member from conductive surfaces within the housing.

10. The inductor assembly of claim 8, wherein the central support includes a plurality of rails secured to the inductors and to the end members.

11. An electronic circuit module for use in a downhole tool string, the module comprising:

a housing configured to be secured to at least one other component in the tool string;

an electronic unit positioned within the housing; and an inductor assembly electrically coupled to the electronic unit and supported within the housing, the inductor assembly including an inductor and an insulative support for positioning the inductor assembly in the housing.

12. The electronic circuit module of claim 11, wherein the inductor includes a plurality of modular inductors electrically coupled in series.

13. The electronic circuit module of claim 11, wherein the insulative support includes a mechanical support portion secured to the inductor and an interface portion secured to the mechanical support portion, the interface portion contacting a support surface within the housing to retain the inductor assembly in a desired position within the housing.

14. The electronic circuit module of claim 13, wherein the mechanical support portion comprises a conductive material and the interface portion comprises an insulative material.

15. The electronic circuit module of claim 14, wherein the inductor assembly includes at least one insulative cover extending over the inductor.

* * * * *